US007824061B1

(12) United States Patent
Riedfort et al.

(10) Patent No.: US 7,824,061 B1
(45) Date of Patent: Nov. 2, 2010

(54) RECHARGEABLE BATTERY POWERED CORDLESS LAMPS

(76) Inventors: Robert A. Riedfort, 19720 N. 83rd Dr., Peoria, AZ (US) 85382; Karen A. Riedfort, 19720 N. 83rd Dr., Phoenix, AZ (US) 95382

( * ) Notice: Subject to any disclaimer, the term of this patent is extended or adjusted under 35 U.S.C. 154(b) by 258 days.

(21) Appl. No.: 12/082,391

(22) Filed: Apr. 10, 2008

Related U.S. Application Data

(60) Provisional application No. 60/923,205, filed on Apr. 13, 2007.

(51) Int. Cl.
*F21L 4/00* (2006.01)
*F21V 23/04* (2006.01)

(52) U.S. Cl. ..... 362/183; 362/276; 362/295

(58) Field of Classification Search ..... 362/183, 362/276, 295, 431, 414, 157
See application file for complete search history.

(56) References Cited

U.S. PATENT DOCUMENTS

| | | | | |
|---|---|---|---|---|
| 3,599,070 | A | 8/1971 | Davis et al. | |
| 3,684,882 | A | 8/1972 | Mininno et al. | |
| 4,177,500 | A | 12/1979 | Nicholl et al. | |
| 4,410,930 | A | 10/1983 | Yachabach | |
| 4,441,143 | A | 4/1984 | Richardson, Jr. | |
| 4,502,102 | A | 2/1985 | Phipps | |
| 4,626,852 | A | 12/1986 | Dodge | |
| 4,901,461 | A | 2/1990 | Edwards et al. | |
| 4,908,567 | A | 3/1990 | Welker et al. | |
| 5,003,432 | A | 3/1991 | Mandy | |
| 5,442,528 | A | 8/1995 | Vandenbelt | |
| 5,490,051 | A | 2/1996 | Messana | |
| 5,564,816 | A | 10/1996 | Arcadia et al. | |
| 6,107,744 | A | 8/2000 | Bavaro et al. | |
| 6,236,622 | B1 | 5/2001 | Blackman | |
| 6,305,820 | B1 | 10/2001 | Poon | |
| 6,443,604 | B1 * | 9/2002 | Rudenberg | 362/488 |
| 6,612,713 | B1 | 9/2003 | Kuelbs | |
| 6,634,768 | B2 | 10/2003 | McKenzie et al. | |
| 6,755,349 | B2 | 6/2004 | Beidokhti | |
| 7,019,464 | B2 * | 3/2006 | Nevins | 315/149 |
| 7,021,787 | B1 | 4/2006 | Kuelbs | |
| 7,021,788 | B2 | 4/2006 | Poon | |
| 7,049,762 | B2 | 5/2006 | Newton | |
| 7,249,864 | B2 | 7/2007 | Smith et al. | |
| 2002/0191396 | A1 * | 12/2002 | Reiff et al. | 362/246 |
| 2003/0067767 | A1 * | 4/2003 | Liu | 362/183 |
| 2004/0252492 | A1 | 12/2004 | Peterson | |
| 2005/0162855 | A1 | 7/2005 | Ip | |
| 2006/0064144 | A1 | 3/2006 | Chen et al. | |
| 2006/0082992 | A1 | 4/2006 | Yuen | |
| 2007/0058365 | A1 | 3/2007 | Anderson et al. | |
| 2007/0127249 | A1 * | 6/2007 | Medley et al. | 362/392 |
| 2007/0211450 | A1 | 9/2007 | You | |
| 2009/0303702 | A1 * | 12/2009 | Ellis et al. | 362/183 |

FOREIGN PATENT DOCUMENTS

| | | |
|---|---|---|
| JP | 09-320771 | 12/1997 |
| WO | WO 93/22752 | 11/1993 |
| WO | WO 98/20276 | 5/1998 |
| WO | WO 2007/079430 A2 | 7/2007 |
| WO | WO 2007/090112 A2 | 8/2007 |

* cited by examiner

*Primary Examiner*—Bao Q Truong
(74) *Attorney, Agent, or Firm*—Adam R. Stephenson, Ltd

(57) ABSTRACT

A cordless lamp is provided which includes at least one rechargeable battery pack in electrical communication with a light and a recharger for use therewith.

11 Claims, 7 Drawing Sheets

RECHARGEABLE BATTERY POWERED CORDLESS LAMPS

RELATED APPLICATION

This application is a continuation-in-part of co-pending application Ser. No. 60/923,205 filed Apr. 13, 2007.

TECHNICAL FIELD

The present invention relates generally to lamps and, more particularly, to a cordless lamp which utilizes rechargeable batteries as a power source.

BACKGROUND OF THE INVENTION

Free standing lamps are well known in the art to provide lighting. As used herein, free standing lamps have a light which is mounted to a stand. Such a stand allows the user to place, within limitations discussed below, the lamp on tables, or alongside furniture for reading, on night stands and many similar locations.

The vast majority of lamps employ electrical cords to connect the lamps to electrical outlets which provide electrical power to the light or lights contained therein. The length of said cord obviously limits the placement of lamps to proximity to such outlets. In addition, the cords themselves can create safety hazards if placed in a walking area. Further, if no electrical outlets are available as, for example, when camping, lamps simply cannot be used.

Thus, there is a need for a cordless lamp. One example addressing this issue is WO 2007/090112 A2 entitled "Battery Powered Lighting Appliance" which was filed on Jan. 30, 2007 by inventors Hoffman et al. on behalf of Eveready Battery Company, Inc. which uses a battery backup for those times when electrical power is lacking.

None of the prior art discloses the present invention.

SUMMARY OF THE INVENTION

It is an object of this invention to provide a cordless lamp utilizing a rechargeable battery.

Further objects and advantages of the invention will become apparent as the following description proceeds and the features of novelty which characterize this invention will be pointed out with particularity in this specification and the claims below.

BRIEF DESCRIPTION OF THE DRAWINGS

The present invention may be more readily described by reference to the accompanying drawings in which.

DETAILED DESCRIPTION OF THE PREFERRED EMBODIMENT

Figure 2:
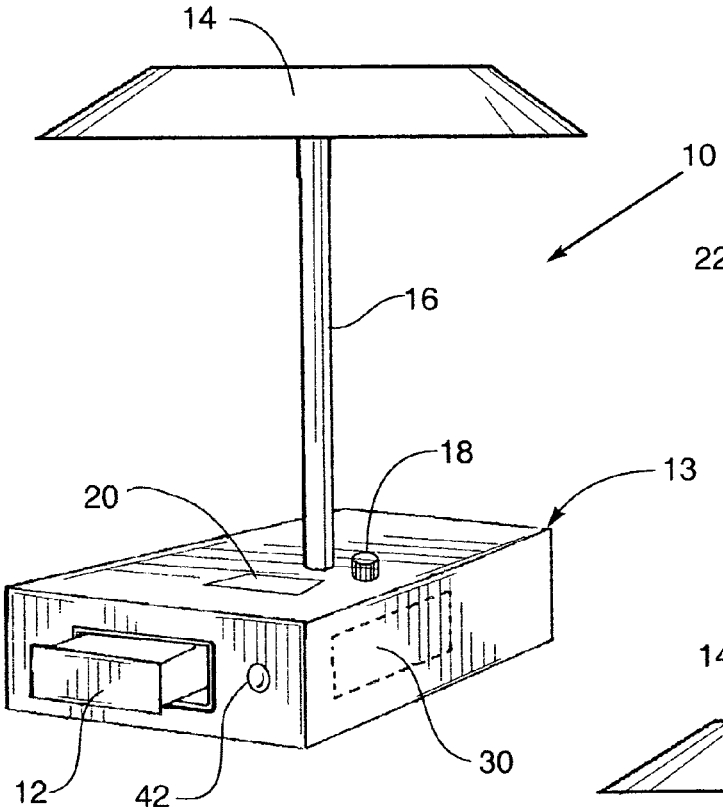
FIG. 2 is a perspective view of a table lamp of the present invention.
Figure 3:
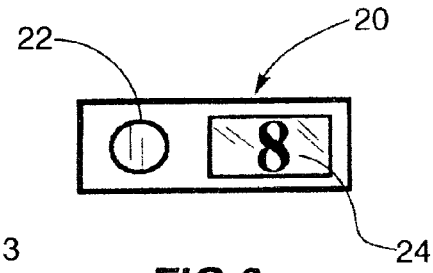
FIG. 3 is a close up of a timer button display used in FIG. 2.

One example of the present invention is a cordless table lamp 10 which is powered by at least one battery pack 12 slidably mounted within a base 13, battery pack 12 being in electrical communication via pole 16 with a light 14 as shown in FIG. 2. A dimmer switch 18 is provided to turn on and turn off light 14 and control the level of light generated by light 14 as desired. Optionally, an infrared (IR) sensor 42 is provided for communication with a remote control device (not shown). Also, optionally a timer controller 20 is provided which is shown in detail in FIG. 3. A button 22 is provided which, in the presently preferred embodiment, controls timer controller 20. Timer controller 20 is off until a user depresses button 22. A timer display 24 will display the numeral "0" indicating the timer is off. Depressing button 22 sequentially causes display 24 show the numerals "2", "4", etc. The displayed numerals correspond to hours that the timer is set. Once set, light 14 will remain illuminated for the selected period of time and automatically shut off once that time is reached.

Those skilled in the art will recognize that the preferred timer can operate in longer or shorter modes, or in a continuous mode, than the presently preferred two hour increments.

Figure 1:
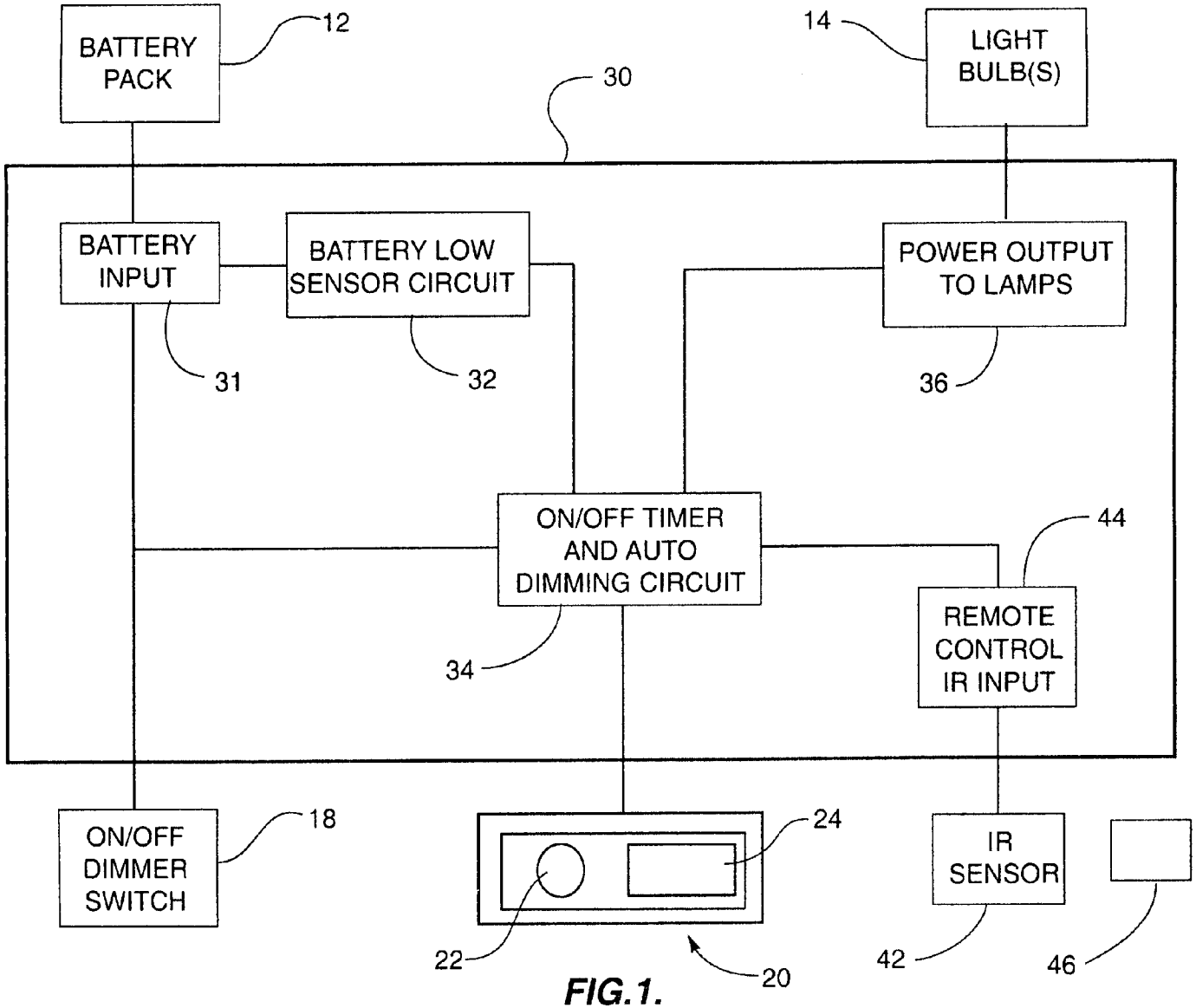
FIG. 1 is a schematic view of the present invention.

A printed circuit board 30 provides control to lamp 10. FIG. 1 shows one embodiment of such a board 30. As shown battery pack 12 provides battery input 31 for electrical power output 36 to light bulbs 14. Board 30 is provided with a battery low sensor circuit 32 which detects the power level in battery pack 12 is low. If low, battery low sensor circuit 32 signals an on/off timer and auto dimming circuit 34 to dim the output of light bulb 14. This dimming signals the user to change battery pack 12 while also extending the time light bulbs 14 are illuminated by reducing the power demand on battery pack 12.

As further shown in FIG. 1, on/off dimmer switch 18 allows a user to turn on (or off) lamp 10 as desired and set the light output of light bulbs 14. Alternatively, timer controller 20 is provided whose operation was described previously and will not be repeated herein.

A further optional feature is the use of a remote control device 40. In the illustrated embodiment, device 40 is an IR functional device though those skilled in the art will recognize that other methods are certainly contemplated within the scope of the invention. Device 40 provides IR signals to, for example, turn on, turn off, dim, actuate timer controller 20 and the like to an IR sensor 42. IR sensor 42 in turn actuates a remote control IR input 44 which carries out the desired functions.

Figure 4:
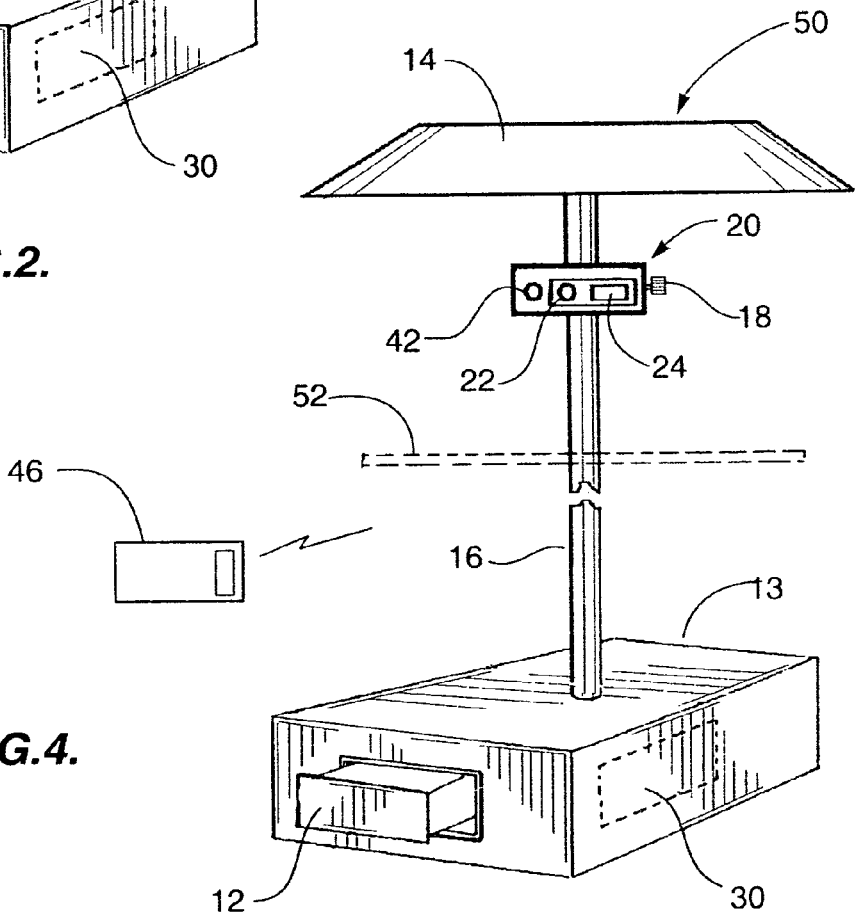
FIG. 4 is a perspective view of a floor lamp of the present invention.

Another variation of is a floor lamp 50 shown in FIG. 4. In this variant, timer controller 20, IR sensor 42 and on/off dimmer switch 18 are mounted to pole 16. Optionally, a table 52 is provided for use by a user. In this variant, base 13 is placed in the floor with pole 16 extending upwardly through table 52 to an appropriate height for a user. IR remote 46 actuates the features of floor lamp 50 as described previously.

Figure 5:
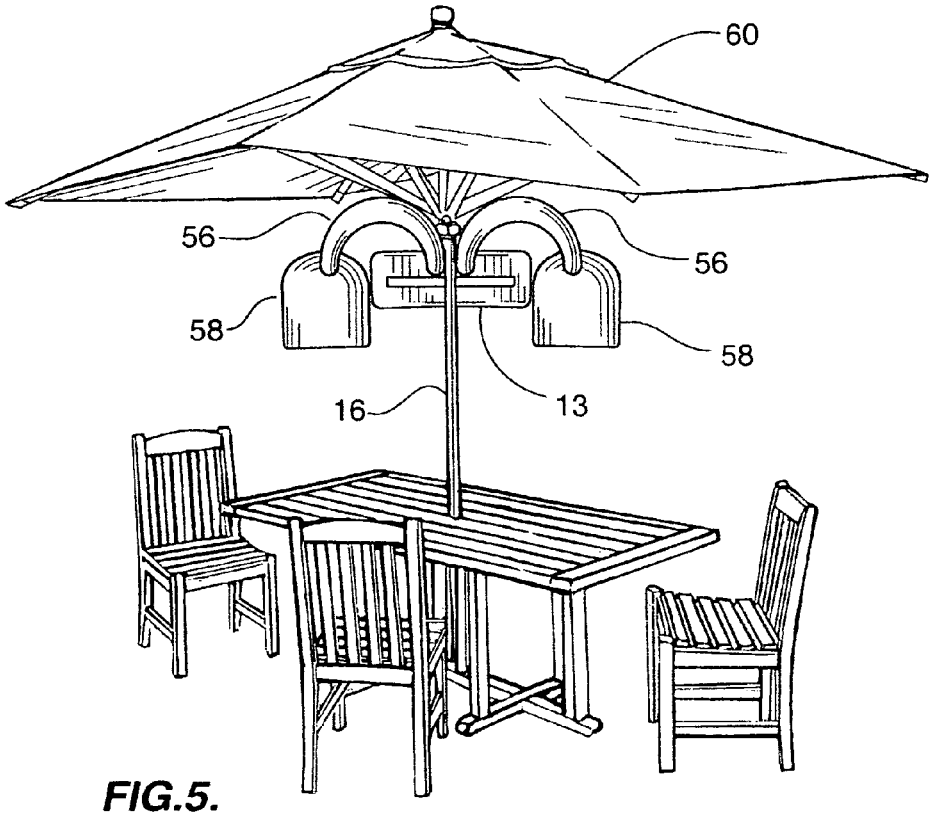
FIG. 5 shows an outdoor table mounted lamp of the present invention.
Figure 11:
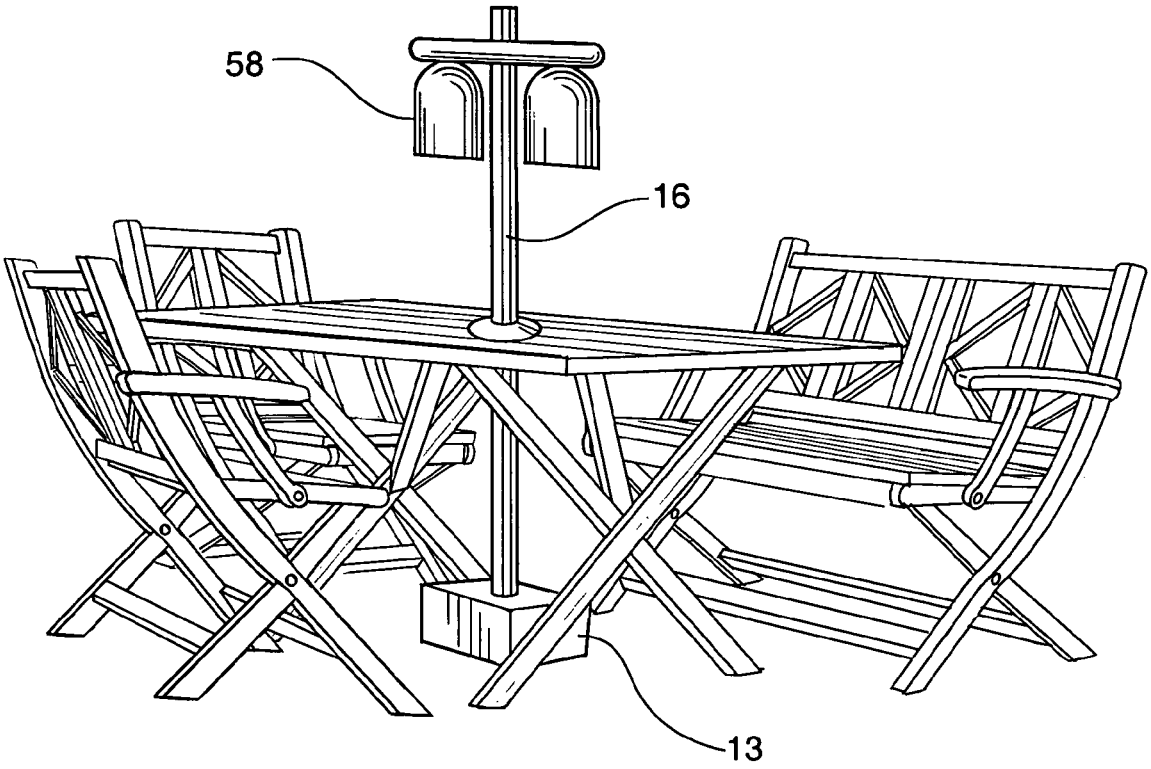
FIG. 11 shows an alternate embodiment of an outdoor table lamp of the present invention.

Still another variant pole mounted lamp 54 is shown in FIG. 5. In this variant, base 13 is mounted directly to pole 16 with curved lamp arms 56 supporting decorative bulbs 58 and providing electrical communication thereto. In this variant, lamp 54 is useful for outdoor patio furniture as shown, mounting to pole 16 which also supports an umbrella 60 for keeping the elements at bay. An alternate embodiment of this variant is shown in FIG. 11 without umbrella 60 and with base 13 on the bottom of pole 16.

Figure 7:
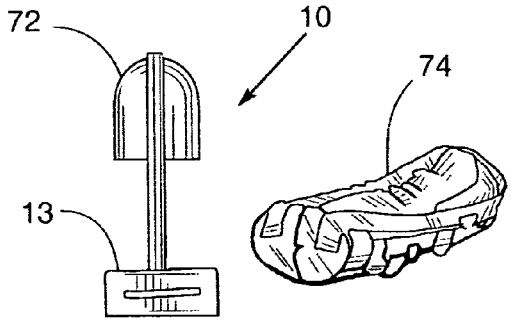
FIG. 7 shows a portable lamp and carrying case therefore suitable for use when camping.

The cordless feature of the present invention makes it suitable for any outdoor activity as the user is not limited to the length of an electrical cord. Thus, as shown in FIG. 7, a camp lamp 70 is shown with base 13 and a light bulb 72. In this variation as with any outdoor variation such as the patio furniture variation shown in connection with FIG. 5, camp lamp 70 is waterproofed to prevent short circuits and the like. For further use, a carrying case 74 is provided for ease of transport.

Figure 6:
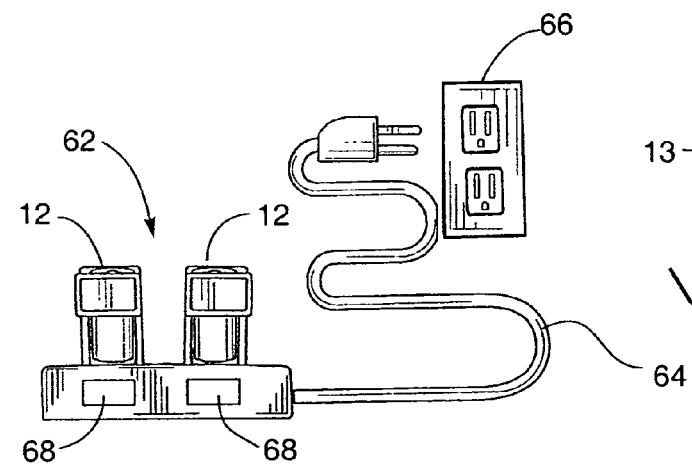
FIG. 6 shows a recharger used in the present invention.
Figure 8:
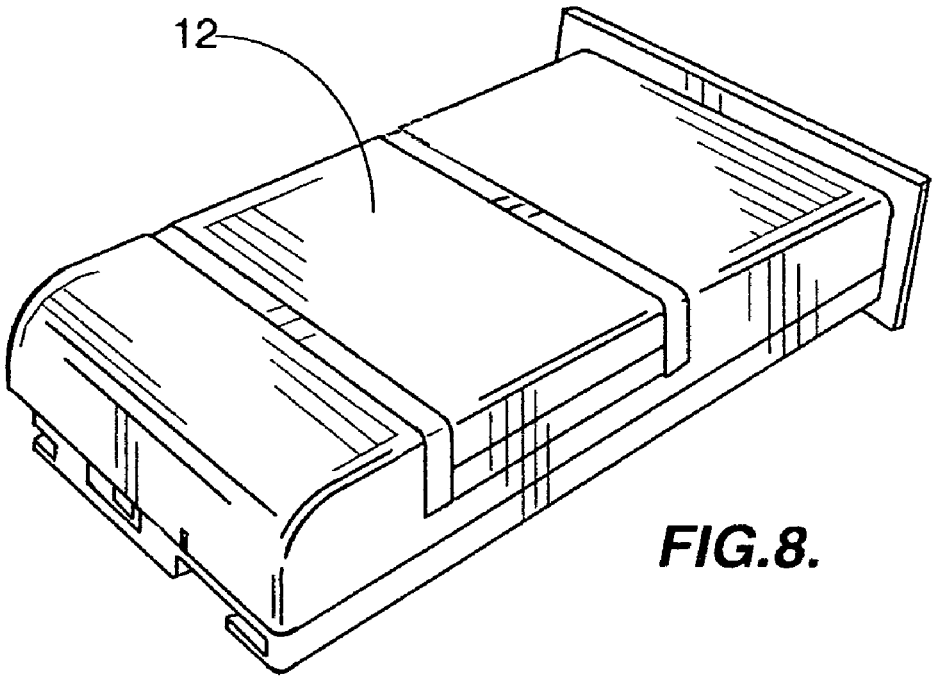
FIG. 8 is a rechargeable battery pack suitable for use with the present invention.
Figure 9:
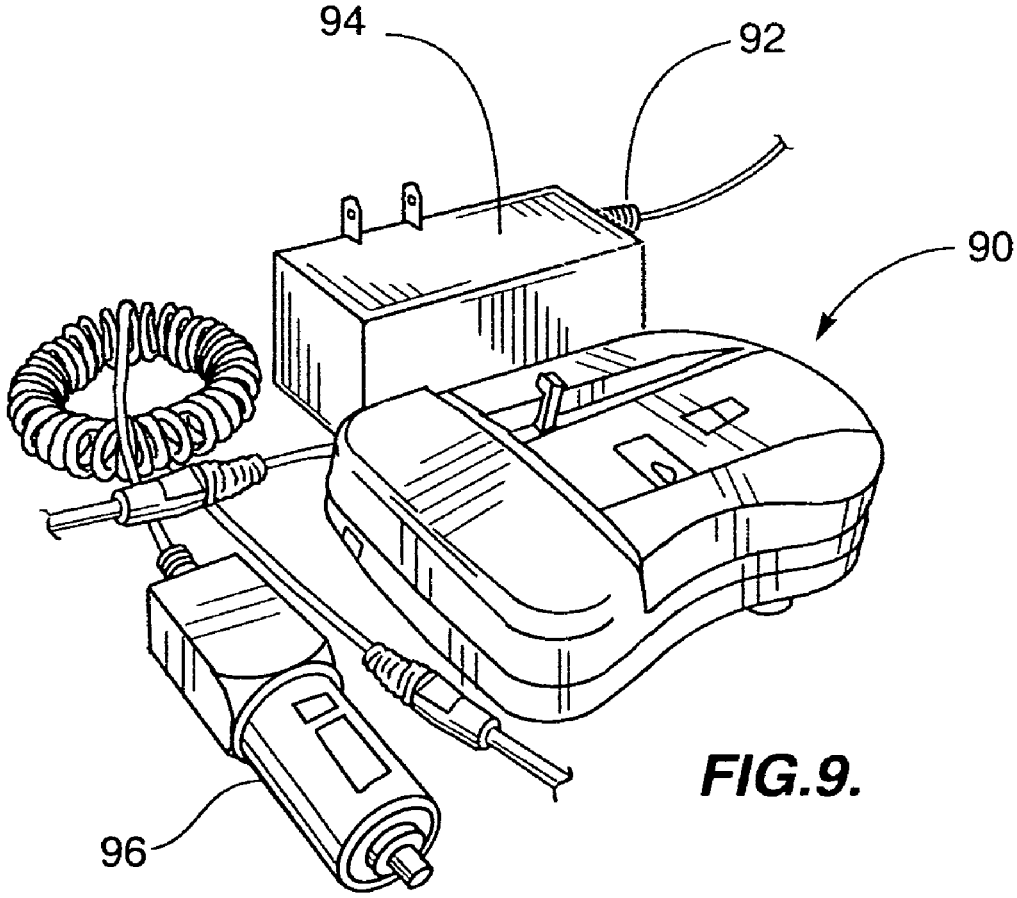
FIG. 9 shows an alternate battery charger suitable for use with both a 12V auto accessory socket and a 120 VAC standard socket.

FIGS. 6, 8 and 9 show accessories useful when used in connection with the present invention. FIG. 6 shows a two station battery recharger 62 having an electrical cord 64 providing electrical communication with a standard outlet 66. In this embodiment, two battery packs 12 mounted in recharger 62 for replenishment of their electrical power. Indicator lights 68 will glow red when charging and change to green when battery packs 12 are fully charged.

FIG. 8 is a close up of a battery pack 12. There are many types of rechargeable batteries on the market today, including, but not limited to, nickel/cadmium, nickel/metal hydride, lithium ion or lithium ion polymer. Any of these variations can be used with the present invention.

FIG. 9 shows an alternate recharger 90 which includes an electrical cord 92 and adapter plug 94 which allows recharger 90 to operate from a standard 120 VAC wall outlet as well as an outlet plug 96 for operation from a 12V automobile accessory outlet.

Figure 12:
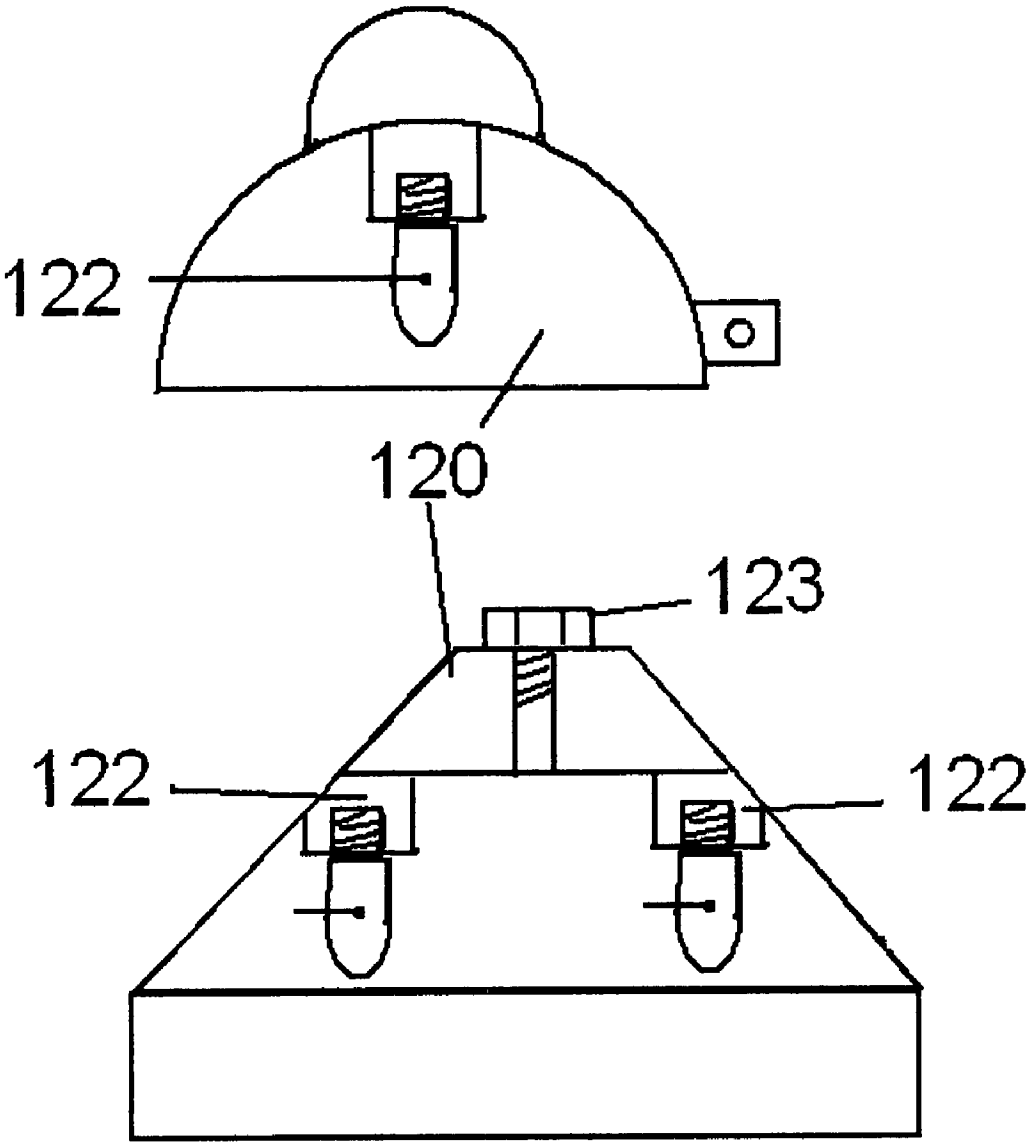
FIG. 12 shows a close up cross section of a lamp shade with light bulbs.

FIG. 12 shows two variants of a lamp shade 120 having light bulbs 122 attached thereto. In one variant, the top of pole 16 (not shown) screws into a receptacle 123 at the top of shade 120 to provide electrical communication to two bulbs 122. In the other variation, pole 16 attaches at an attachment point 124 to provide electrical communication to one bulb 122.

While the invention has been particularly shown and described with reference to a preferred embodiment, it will be understood by those skilled in the art that various changes inform and detail may be made therein without departing from the spirit and scope of the invention.

That which is claimed is:

1. A cordless lamp comprises a rechargeable battery pack in electrical communication with a light, a recharger for use therewith, and a rechargeable battery low sensor circuit which detects when the rechargeable battery pack is low on power, the rechargeable battery low sensor providing notice of the low on power battery pack to the user, the notice being provided by dimming the light.

2. The cordless lamp of claim 1 wherein the rechargeable battery pack is slidably mounted with a base.

3. The cordless lamp of claim 2 wherein the light is mounted on a pole extending upwardly from the base, the pole providing electrical communication between the rechargeable battery pack and the light.

4. The cordless lamp of claim 1 further comprising a dimmer switch provided to turn on and turn off the light and control the level of light generated by light as desired.

5. The cordless lamp of claim 1 further comprising a remote sensor in communication with a remote control device for turning on and turning off the light as desired.

6. The cordless lamp of claim 5 wherein the remote sensor is an infrared sensor and the remote control device senses infrared.

7. The cordless lamp of claim 1 further comprising a timer controller, the timer controller having a timer which can be set to desired times for the light to remain illuminated, the light being turned off once the desired times are reached.

8. The cordless lamp of claim 1 which is waterproof.

9. The cordless lamp of claim 1 further comprising a recharger which is adapted to use both a 120 VAC standard outlet and an automobile accessory plug for recharging the battery pack.

10. A waterproof cordless lamp comprises:

at least one rechargeable battery pack in electrical communication with a light and a recharger for use therewith, the at least one rechargeable battery pack being slidably mounted with a base, the light being mounted on a pole extending upwardly from the base, the pole providing electrical communication between the rechargeable battery pack and the light, a dimmer switch provided to turn on and turn off the light and control the level of light generated by light as desired, a remote sensor in communication with a remote control device for turning on and turning off the light as desired, a timer controller, the timer controller having a timer which can be set to desired times for the light to remain illuminated, the light being turned off once the desired times are reached, a rechargeable battery low sensor circuit which detects when the rechargeable battery pack is low on power, rechargeable battery low sensor providing notice of the low on power battery pack to the user by dimming the light, and a recharger which is adapted to use both a 120 VAC standard outlet and an automobile accessory plug for recharging the battery pack.

11. The cordless lamp of claim 10 wherein the remote sensor is an infrared sensor and the remote control device senses infrared.

* * * * *

UNITED STATES PATENT AND TRADEMARK OFFICE

CERTIFICATE OF CORRECTION

PATENT NO. : 7,824,061 B1
APPLICATION NO. : 12/082391
DATED : November 2, 2010
INVENTOR(S) : Robert A. Riedfort and Karen A. Riedfort It is certified that error appears in the above-identified patent and that said Letters Patent is hereby corrected as shown below:

On the cover page, in the Inventors item (76) the address of co-inventor Karen A. Riedfort should be canceled and replaced with the following:

19720 N. 83rd Dr., Peoria, AZ (US) 85382

Column 2, line 28, cancel the text "24 show" and insert --24 to show--.

Column 2, line 61, cancel the text "variation of is" and insert --variation is--.

Figure 10:
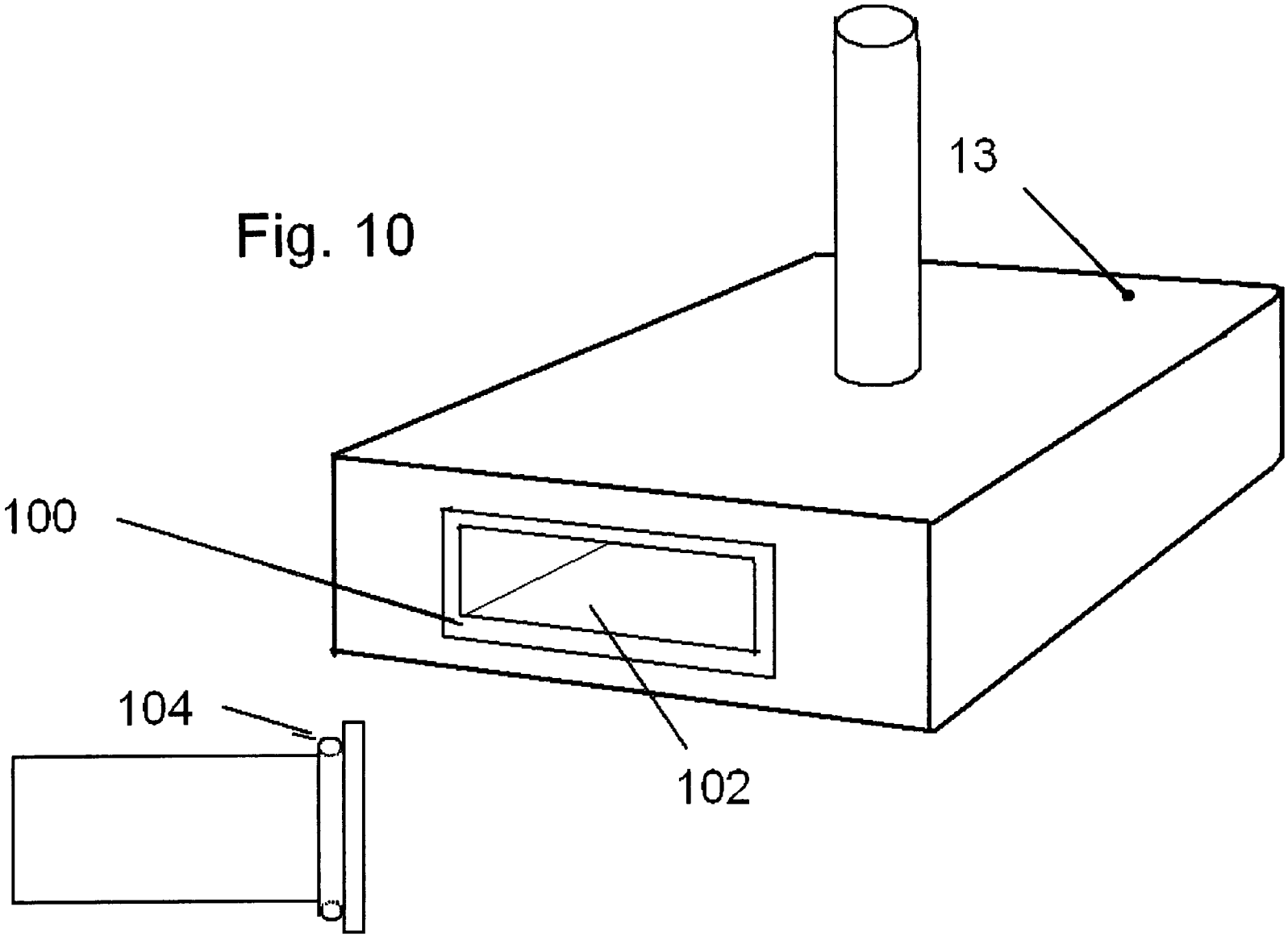
FIG. 10 shows a waterproofed embodiment of the present invention.

Column 3, line 10, cancel the paragraph beginning with "The cordless feature" and ending with "transport." and insert the following paragraph:

--The cordless feature of the present invention makes it suitable for any outdoor activity as the user is not limited to the length of an electrical cord. Thus, as shown in Fig. 7, a camp lamp 70 is shown with base 13 and a light bulb 72. In this variation as with any outdoor variation such as the patio furniture variation shown in connection with Fig. 5, camp lamp 70 is waterproofed to prevent short circuits and the like. For further use, a carrying case 74 is provided for ease of transport. As shown in Fig. 10, base 13 includes a flattened area 100 around a battery receiving cavity 102. Flattened area 100 mates with a gasket 104 mounted on battery pack 12 to provide waterproofing for said device.--

Column 3, line 23, cancel the text "packs 12 mounted" and insert --packs 12 are mounted--.

Column 3, line 46, cancel the word "inform" and insert --in form--.

Signed and Sealed this
Twenty-ninth Day of March, 2011

David J. Kappos

David J. Kappos
*Director of the United States Patent and Trademark Office*